United States Patent [19]

Kobayashi et al.

[11] 3,999,524

[45] Dec. 28, 1976

[54] CONTROL SYSTEM FOR CONTROLLING OPENING OF THROTTLE VALVE

[75] Inventors: Tsuneo Kobayashi; Hidetaka Nohira, both of Susono, Japan

[73] Assignee: Toyota Jidosha Kogyo Kabushiki Kaisha, Toyota, Japan

[22] Filed: Feb. 28, 1975

[21] Appl. No.: 554,191

[30] Foreign Application Priority Data

June 6, 1974 Japan ..... 49-64303

[52] U.S. Cl. ..... 123/103 R; 180/108

[51] Int. Cl.[2] ..... F02D 11/08

[58] Field of Search ..... 123/97 R, 103 R, 97 B; 180/108

[56] References Cited

UNITED STATES PATENTS

| | | | |
|---|---|---|---|
| 2,988,074 | 6/1961 | Lobdell et al. | 123/103 R X |
| 3,027,884 | 4/1962 | Bale, Jr. et al. | 123/97 B |
| 3,133,610 | 5/1964 | Sheppard | 123/103 R X |
| 3,266,473 | 8/1966 | Rhodes | 123/103 R |
| 3,446,193 | 5/1969 | Boller | 123/97 R |
| 3,788,288 | 1/1974 | Harrison et al. | 123/97 B |
| 3,795,237 | 3/1974 | Denton | 123/97 B X |

*Primary Examiner*—Wendell E. Burns
*Assistant Examiner*—William C. Anderson
*Attorney, Agent, or Firm*—Stevens, Davis, Miller & Mosher

[57] ABSTRACT

A control system for controlling the opening of a throttle valve of a vehicle comprises a throttle valve actuating mechanism and a diaphragm apparatus including a diaphragm member which divides the casing of the diaphragm apparatus into two chambers, the first chamber being communicated through an orifice and air chamber with an intake manifold leading to an engine while the second chamber being communicated directly with the intake manifold.

When a vehicle is decelerated, the vacuum in the intake manifold is increased with the result that the vacuum in the second chamber is increased while the vacuum in the first chamber does not increase, because of the presence of the orifice and air chamber so that the vacuum in the second chamber will become higher than that in the first chamber, pulling the diaphragm member toward the second chamber, which drives the throttle valve actuating mechanism to actuate the throttle valve to open to feed more air fuel mixture, thus preventing misfire. It follows that the discharge of unburned hydrocarbons will be reduced.

5 Claims, 2 Drawing Figures

CONTROL SYSTEM FOR CONTROLLING OPENING OF THROTTLE VALVE

BACKGROUND OF THE INVENTION

The present invention relates to a system for controlling the opening of a throttle valve of a vehicle.

In general, when a vehicle incorporating a gasoline engine is decelerated, the vacuum in the intake manifold to the engine is increased, making the intake efficiency of the engine lower with the result that misfire is likely to take place. As a result, a considerable concentration of unburned hydrocarbons is discharged. In order to meet recent regulations to control environmental pollution, it has been proposed that the throttle valve should be controlled so as to improve the burning efficiency. A throttle positioner, for example, electrically senses vehicle speed, thereby producing an electrical signal which actuates a solenoid valve, intermittently transmitting the vacuum in the intake manifold to the diaphragm, thus opening the throttle valve by a predetermined level. The throttle positioner, however, becomes complicated and expensive due to the employment of expensive devices including a vehicle speed senser, a computer and a vacuum switching solenoid so as to electrically sense and control vehicle speed.

SUMMARY OF THE INVENTION

It is an object of the invention to provide a system for controlling the opening of a throttle valve, the system being composed of only mechanical components to provide a simple and inexpensive construction.

Another object of the invention is to provide a system for controlling the opening of a throttle valve, when a vehicle incorporating a gasoline engine with a carburetor is decelerated, so that misfire may be prevented so as to reduce the amount of unburned hydrocarbons discharged to the atmosphere.

According to one aspect of the invention, there is provided a system for controlling the opening of a throttle valve of a vehicle comprising a control apparatus provided between an intake manifold leading to an engine and the throttle valve, the apparatus being responsive to the change in the negative pressure in the intake manifold to mechanically control the opening of the throttle valve, thus providing the improved conditions for burning of an air-fuel mixture in the engine.

BRIEF DESCRIPTION OF THE DRAWINGS:

Further objects and features of the present invention will now be described with references being made to the attached drawings in which.

Figure 1:
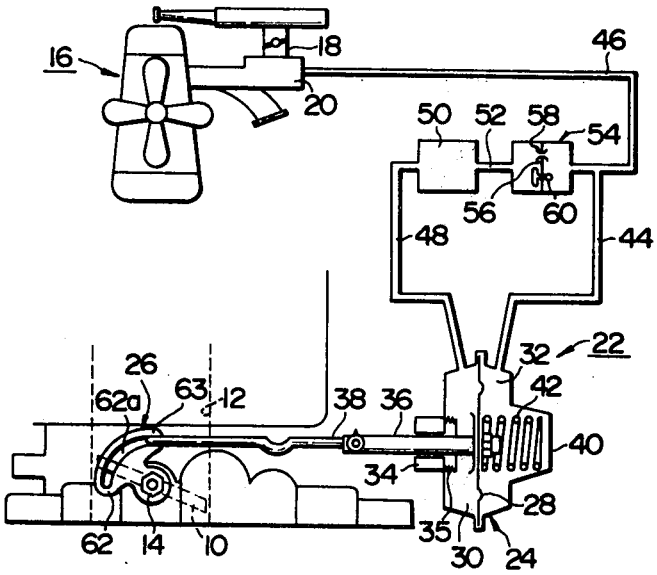
FIG. 1 is a schematic diagram of a system for controlling the opening of a throttle valve of a vehicle embodying the invention.

DETAILED DESCRIPTION OF THE PREFERRED EMBODIMENTS:

Referring to the attached drawings, in FIG. 1, a throttle valve 10 is located within a throttle bore 12 and is fixed to a throttle shaft 14 for rotation. An engine 16 is provided with an intake manifold 20 leading to a carburetor 18. A control system generally denoted by 22 mechanically controls the opening of the throttle valve 10 being responsive to the change in vacuum in the intake manifold 20. In this embodiment illustrated, the control system 22 includes a diaphragm apparatus 24 and a throttle actuating mechanism 26. The casing of the diaphragm apparatus 24 is divided into two chambers 30 and 32 by a diaphragm member 28. One chamber 30 is provided with a bearing member 34 slideably supporting a shaft 36. A bellows member 35 is attached at one end to the shaft 36, and at the other end to the opening of the bearing 34, making the chamber 30 airtight. The shaft 36 is connected at one end to the central portion of the diaphragm member 28 and at the other end to one end of a link member 38. The other chamber 32 is provided with a cup-shaped actuator 40 in which is disposed a spring member 42 determining the starting pressure at which the diaphragm member 28 is actuated. The chamber 30 is communicated through a pipe 48, an air chamber 50, a pipe 52, a control valve device 54 and a pipe 46 with the intake manifold 20. The control valve device 54 has a partition 56 on which are provided a check valve 60 and an orifice 58, for example, an opening of 0.5 mm in diameter. A pressure difference is established between the chambers 30 and 32 by the presence of the control valve device 54 and the air chamber 50 responsive to the vacuum in the intake manifold 20, causing the shaft 36 to move to the right as shown in FIG. 1.

The throttle actuating mechanism 26 consists of a guide member 62 bolted to the throttle shaft 14 for rotation in company with the latter and throttle valve 10. The link member 38 is provided at one end with a guide pin 63 moving along a circular groove or slot **62-*a* formed in the guide member 62. When the throttle valve 10 is operated to turn clockwise by depressing an accelerator pedal (not shown), the guide pin 63 moves along the groove 62*a*, having no effect on the link member 38. When a pressure difference is established between the two chambers 30 and 32, the diaphragm 28 is actuated to move to the right, moving the shaft 36 to the right along with the link 38, thereby turning clockwise the guide member 62 together with the throttle valve 10**.

Operation will be described in more detail. When a vehicle is decelerated from a normal or accelerating driving, the vacuum in the intake manifold 20 is rapidly increased to cause a pressure difference to be established between the diaphragm chamber 32 and the diaphragm chamber 30 to which the negative pressure is permitted to enter through the control valve device 54 and air chamber 50. Since such rapid increase in the vacuum in the intake manifold 20 is permitted to enter into the chamber 30 only through the fine orifice 58 provided within the control valve device 54, while it is allowed to go directly into the chamber 32, a pressure difference will be established between the chambers 30 and 32. As a result, the diaphragm 28 is deformed towards the chamber 32, which moves the shaft 36 to the right, thus controlling the opening of the throttle valve 10, as described above. This pressure difference, however, will diminish as time goes on, which permits the diaphragm 28, shaft 38 and throttle actuating mechanism 26 to return to the original position. The period of time for which the pressures in both chambers 30 and 32 balance each other i.e. for which the throttle valve 10 is opened, depends upon the diameter of the orifice 58 and the capacity of the air chamber 50.

Assuming that the control valve device 54 is not provided with the check valve 60, when the vacuum in the intake manifold is decreased, the vacuum in the diaphragm chamber 30 remains high for a period of time determined by the diameter of the orifice 58 and the capacity of the air chamber 50. As a result, when the vacuum in the intake manifold is increased immediately after decreased, the vacuum in the diaphragm chamber 30 is still high so that a high vacuum admitted to the diaphragm chamber 32 is not enough to actuate the diaphragm 28 to move as desired.

In case the control valve device 54 is provided with the check valve 60, as soon as the vacuum in the intake manifold is lower than that in the chamber 30, the check valve 60 is opened to cause the negative pressure in the diaphragm chamber 30 to be decreased to balance with that in the diaphragm chamber 32. Consequently, even if the vacuum in the intake manifold is increased immediately after decreased, since the vacuum in the diaphragm chamber 30 is low, the high vacuum admitted to the diaphragm chamber 32 is able to actuate the diaphragm 28 to move to the right, driving the throttle valve 10 to open to feed more air fuel mixture, thus reducing the discharge of unburned hydrocarbons.

Figure 2:
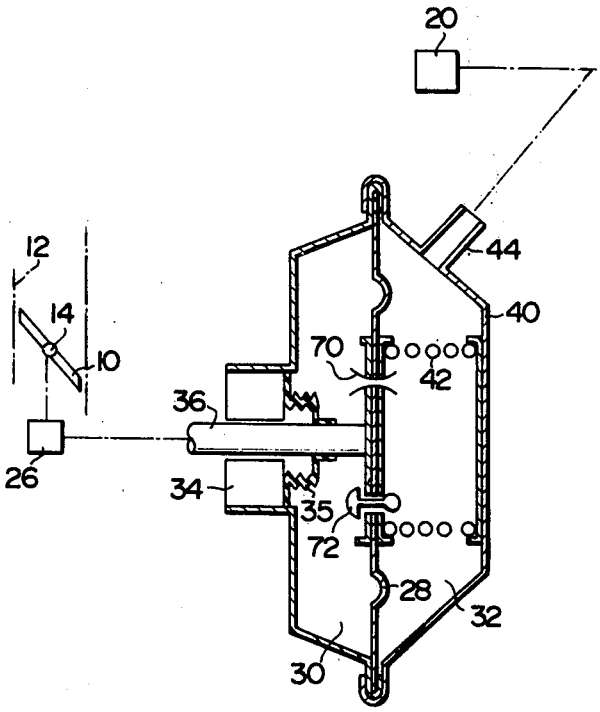
FIG. 2 is a schematic sectional view of an alternate embodiment of the invention.

FIG. 2 shows a modified diaphragm apparatus for use in a control system for controlling the opening of the throttle valve according to the invention. The same numerals represent the same members as in FIG. 1. In this embodiment, the chamber 32 communicates with the intake manifold 20 while the chamber 30 does not communicate with same. The diaphragm 28, however, is provided with an orifice 70 and check valve 72. The chamber 30 also serves as the air chamber 50 in FIG. 1.

When the vacuum in the intake manifold 20 is rapidly increased, the diaphragm 28 expands to the right as shown in FIG. 2, moving the shaft 36 to the right, which drives the throttle actuating mechanism 26 to actuate the throttle valve to open to feed more air fuel mixture. As time passes, the diaphragm 28 will return to its original position, thereby closing the throttle valve 10 to its idle position.

The arrangements as constructed in accordance with the invention have the following advantages:

1. When the vacuum is rapidly increased, the throttle valve is automatically controlled to open during a certain period of time thereafter, so that misfire may be prevented with the result that the discharge of unburned hydrocarbons is effectively reduced.

2. This control system is consisted only of mechanical components so that it is low in cost as well as high in reliability, which makes a remarkable difference from the conventional electrical system in these respects.

3. The conventional throttle positioner which is controlled by the detection of vehicle speed cannot control the opening of the throttle valve in process of time, it follows that when the vehicle is decelerated on a downhill, it continues to open the throttle valve, resulting in a poor engine breaking. On the contrary, the control system in accordance with the invention will open the throttle valve during only a certain period of time after the vehicle is decelerated, thus providing a good engine breaking.

What is claimed is:

1. A control system for controlling the opening of a throttle valve of a vehicle, said system comprising a control apparatus between an intake manifold leading to an engine and the throttle valve, the apparatus being responsive to change in vacuum in the intake manifold to mechanically control the opening of the throttle valve for providing improved conditions for the burning of fuel in the engine and comprising a diaphragm assembly communicated with said intake manifold and a throttle actuating mechanism connected to said diaphragm assembly and to the throttle valve, said diaphragm assembly including a diaphragm member dividing a casing of said assembly into first and second chambers, said control apparatus including a control valve device and an air chamber in series between said first chamber and said intake manifold, and a pipe member connected to said second chamber and the intake manifold, thereby providing a delay in the transmission of vacuum in the intake manifold to said first chamber.

2. A control system as defined in claim 1 wherein said control valve device comprises a partition dividing a housing of said device into first and second compartments, an orifice defined in said partition for communicating said two compartments, and a check valve supported by said partition for transmitting pressure from said first compartment to said second compartment but preventing pressure from being transmitted from said second compartment to said first compartment.

3. A control system as defined in claim 1 wherein said pipe member is directly connected to said second chamber and to said intake manifold, said diaphragm member having an orifice defined therein for fluidly communicating said first and second chambers, and a check valve for transmitting pressure from said second chamber to said first chamber but preventing vacuum from being so transmitted.

4. In an engine having an intake manifold and a throttle valve, the improvement comprising a control system for controlling the opening of said throttle valve, said system comprising:

a diaphragm assembly comprising:
- a casing; and
- a diaphragm dividing said casing into first and second chambers;
- a throttle valve actuating mechanism connected to and movable by said diaphragm;
- a pipe member directly fluidly communicating said intake manifold and said second chamber; and
- a control valve device and an air chamber in series between said intake manifold and said first chamber for fluidly communicating said intake manifold and said first chamber;

said control valve device comprising:
- a housing;
- a partition dividing said housing into first and second compartments;
- an orifice defined in said partition for fluidly communicating said first and second compartments; and
- a check valve on said partition for transmitting pressure from said first compartment to said second compartment but preventing pressure from being transmitted from said second compartment to said first compartment whereby when the intake manifold vacuum is increased, it is transmitted to the second chamber without substantial delay and to the first chamber with delay to move the diaphragm and the throttle valve actuating mechanism and thereby open the throttle valve.

5. In an engine having an intake manifold and a throttle valve, the improvement comprising a control system for controlling the opening of said throttle valve, said system comprising:

a diaphragm assembly comprising:

a casing;

a diaphragm dividing said casing into first and second chambers;

an orifice defined in said diaphragm for communicating said first and second chambers; and a check valve on said diaphragm for transmitting positive pressure from said second chamber to said first chamber but preventing vacuum from being so transmitted;

a throttle actuating mechanism connected to and movable by said diaphragm; and a pipe member directly fluidly communicating said intake manifold and said second chamber whereby when the intake manifold vacuum is increased, it is transmitted to the second chamber without substantial delay and to the first chamber with delay to move the diaphragm and the throttle valve actuating mechanism and thereby open the throttle valve.

* * * * *